US006229506B1

(12) United States Patent
Dawson et al.

(10) Patent No.: US 6,229,506 B1
(45) Date of Patent: May 8, 2001

(54) ACTIVE MATRIX LIGHT EMITTING DIODE PIXEL STRUCTURE AND CONCOMITANT METHOD

(75) Inventors: Robin Mark Adrian Dawson, Princeton; Michael Gillis Kane, Skillman; James Ya-Kong Hsu, Edison; Fu-Lung Hsueh, Cranbury; Alfred Charles Ipri, Princeton; Roger Green Stewart, Neshanic Station, all of NJ (US)

(73) Assignee: Sarnoff Corporation, Princeton, NJ (US)

( * ) Notice: Subject to any disclaimer, the term of this patent is extended or adjusted under 35 U.S.C. 154(b) by 0 days.

(21) Appl. No.: 09/064,696

(22) Filed: Apr. 22, 1998

Related U.S. Application Data

(60) Provisional application No. 60/044,174, filed on Apr. 23, 1997.

(51) Int. Cl.[7] ..... G09G 3/32

(52) U.S. Cl. ..... 345/82; 345/92

(58) Field of Search ..... 345/82, 92, 76, 345/46, 83; 315/169.4, 169.1, 169.3; 340/815.45

(56) References Cited

U.S. PATENT DOCUMENTS

| | | | |
|---|---|---|---|
| 3,590,156 | 6/1971 | Easton | 178/7.5 D |
| 3,761,617 | 9/1973 | Tsuchiya et al. | 178/7.3 D |
| 4,006,383 | 2/1977 | Luo et al. | 315/169 TV |
| 4,114,070 | 9/1978 | Asars | 315/169 TV |
| 4,482,841 | 11/1984 | Tiku et al. | 313/503 |
| 4,528,480 | 7/1985 | Unagami et al. | 315/169.1 |
| 4,532,506 | 7/1985 | Kitazima et al. | 340/784 |
| 4,554,539 | 11/1985 | Graves | 340/805 |
| 4,613,793 | 9/1986 | Panicker et al. | 315/169.3 |
| 4,652,872 | 3/1987 | Fujita | 340/781 |
| 4,736,137 | 4/1988 | Ohwada et al. | 315/169.3 |
| 4,797,667 | 1/1989 | Dolinar et al. | 340/781 |
| 4,957,747 | 9/1990 | Tuenge et al. | 313/506 |
| 4,958,105 | 9/1990 | Young et al. | 315/169.3 |
| 4,962,374 | 10/1990 | Fujioka et al. | 340/781 |
| 4,963,861 | 10/1990 | Thioulouse et al. | 340/781 |
| 4,975,691 | 12/1990 | Lee | 340/781 |
| 5,003,302 | 3/1991 | Richard et al. | 340/719 |
| 5,028,916 | 7/1991 | Ichikawa et al. | 340/784 |
| 5,063,378 | 11/1991 | Roach | 340/784 |

(List continued on next page.)

OTHER PUBLICATIONS

J. Vanfleteren, P. De Visschere, J. De Baets, I. De Rycke, J. Doutreloigne, A. Van Calster, "Active Matrix CdSe TFT Addressed Electroluminescent Displays", International Display Research Conference 1988, San Diego, pp. 74–76.

J. Vanfleteren, J. Capon, J. De Baets, I. De Rycke, H. De Smet, J. Doutreloigne, A. Van Calster, P. De Visschere, "Evaluation of a 64×64 CdSe TFT Addressed ACTFEL Display Demonstrator", Proceedings IEEE, 1991.

J. Vanfleteren, J. De Baets, I. De Rycke, H. De Smet, J. Doutreloigne, A. Van Calster, P. Visschere, "Design of a Prototype Active Matrix CdSe TFT Addressed EL Display", Eurodisplay 1991, pp. 216–219.

J. P. Salerno, D. P. Vu, B. D. Dingle, M. W. Batty, A. C. Ipri, R. G. Stewart, D. L. Jose, M. L. Tilton, "Single–Crystal Silicon Transmissive AMLCD", SID 92 Digest, pp. 63–66.

T. Suzuki, Y. Uno, J. Sakurai, Y. Sato, S. Kyozuka, N. Hiji, T. Ozawa, "The Fabrication of TFEL Displays Driven by a–Si TFTs", SID 92 Digest, pp. 344–347.

*Primary Examiner*—Dennis-Doon Chow
(74) *Attorney, Agent, or Firm*—William J. Burke

(57) ABSTRACT

A LED pixel structure that reduces current nonuniformities and threshold voltage variations in a "drive transistor"of the pixel structure is disclosed. The LED pixel structure incorporates a current source for loading data into the pixel via a data line. Alternatively, an auto zero voltage is determined for the drive transistor prior to the loading of data.

16 Claims, 6 Drawing Sheets

U.S. PATENT DOCUMENTS

| | | | |
|---|---|---|---|
| 5,079,483 | 1/1992 | Sato | 315/169.3 |
| 5,095,248 | 3/1992 | Sato | 315/169.3 |
| 5,172,032 | 12/1992 | Alessio | 315/169.3 |
| 5,302,966 | 4/1994 | Stewart | 345/76 |
| 5,463,279 | 10/1995 | Khormaei | 315/169.3 |
| 5,670,979 * | 9/1997 | Huq et al. | 345/100 |
| 5,684,365 | 11/1997 | Tang et al. | 315/169.3 |
| 5,952,789 * | 9/1999 | Stewart et al. | 345/82 |

* cited by examiner

ACTIVE MATRIX LIGHT EMITTING DIODE PIXEL STRUCTURE AND CONCOMITANT METHOD

This application claims the benefit of U.S. Provisional Application No. 60/044,174 filed Apr. 23, 1997, which is herein incorporated by reference.

This invention was made with U.S. government support under contract number F33615-96-2-1944. The U.S. government has certain rights in this invention.

The invention relates to an active matrix light emitting diode pixel structure. More particularly, the invention relates to a pixel structure that reduces current nonuniformities and threshold voltage variations in a "drive transistor" of the pixel structure and method of operating said active matrix light emitting diode pixel structure.

BACKGROUND OF THE DISCLOSURE

Matrix displays are well known in the art, where pixels are illuminated using matrix addressing as illustrated in FIG. 1. A typical display 100 comprises a plurality of picture or display elements (pixels) 160 that are arranged in rows and columns. The display incorporates a column data generator 110 and a row select generator 120. In operation, each row is sequentially activated via row line 130, where the corresponding pixels are activated using the corresponding column lines 140. In a passive matrix display, each row of pixels is illuminated sequentially one by one, whereas in an active matrix display, each row of pixels is first loaded with data sequentially. Namely, each row in the passive matrix display is only "active" for a fraction of the total frame time, whereas each row in the active matrix display can be set to be "active" for the entire total frame time.

With the proliferation in the use of portable displays, e.g., in a laptop computer, various display technologies have been employed, e.g., liquid crystal display (LCD) and light-emitting diode (LED) display. An important distinction between these two technologies is that a LED is an emissive device which has power efficiency advantage over non-emissive devices such as (LCD). Generally, an important criticality in portable displays is the ability to conserve power, thereby extending the "on time" of a portable system that employs such display.

In a LCD, a fluorescent backlight is on for the entire duration in which the display is in use, thereby dissipating power even for "off" pixels. Namely, all pixels in a LCD are illuminated, where a "dark" or "off" pixel is achieved by causing a polarized layer to block the illumination through that pixel. In contrast, a LED (or OLED) display only illuminates those pixels that are activated, thereby conserving power by not having to illuminate off pixels.

Although a display that employs an OLED pixel structure can as reduce power consumption, such pixel structure exhibits nonuniformity in intensity level over time. Namely, the OLED structure will degrade with use, where it has been found that the turn-on voltage of an organic OLED increases over life, with the voltage increase dependent on the total time-integrated charge density through the OLED.

With use, the gate to source voltage (threshold voltage) of the "drive transistor" M2 may vary, thereby causing a change in the current passing through the LED. This varying current contributes to the nonuniformity in the intensity of the display.

Another contribution to the nonuniformity in intensity of the display can be found in the manufacturing of the "drive transistor". In some cases, the "drive transistor" is manufactured from a material that is difficult to ensure uniformity of the transistors such that variations exist from pixel to pixel.

However, it has been observed that the brightness of the OLED is proportional to the current passing through the OLED. Therefore, a need exists in the art for a pixel structure and concomitant method that reduces current nonuniformities and threshold voltage variations in a "drive transistor" of the pixel structure.

SUMMARY OF THE INVENTION

In one embodiment of the present invention, a current source is incorporated in a LED (OLED) pixel structure that reduces current nonuniformities and threshold voltage variations in a "drive transistor" of the pixel structure. The current source is coupled to the data line, where a constant current is initially programmed and then captured.

In another embodiment, the constant current is achieved by initially applying a reference voltage in an auto-zero phase that determines and stores an auto zero voltage. The auto zero voltage effectively accounts for the threshold voltage of the drive transistor. Next, a data voltage which is referenced to the same reference voltage is now applied to illuminate the pixel.

BRIEF DESCRIPTION OF THE DRAWINGS

The teachings of the present invention can be readily understood by considering the following detailed description in conjunction with the accompanying drawings, in which.

To facilitate understanding, identical reference numerals have been used, where possible, to designate identical elements that are common to the figures.

DETAILED DESCRIPTION

Figure 2:
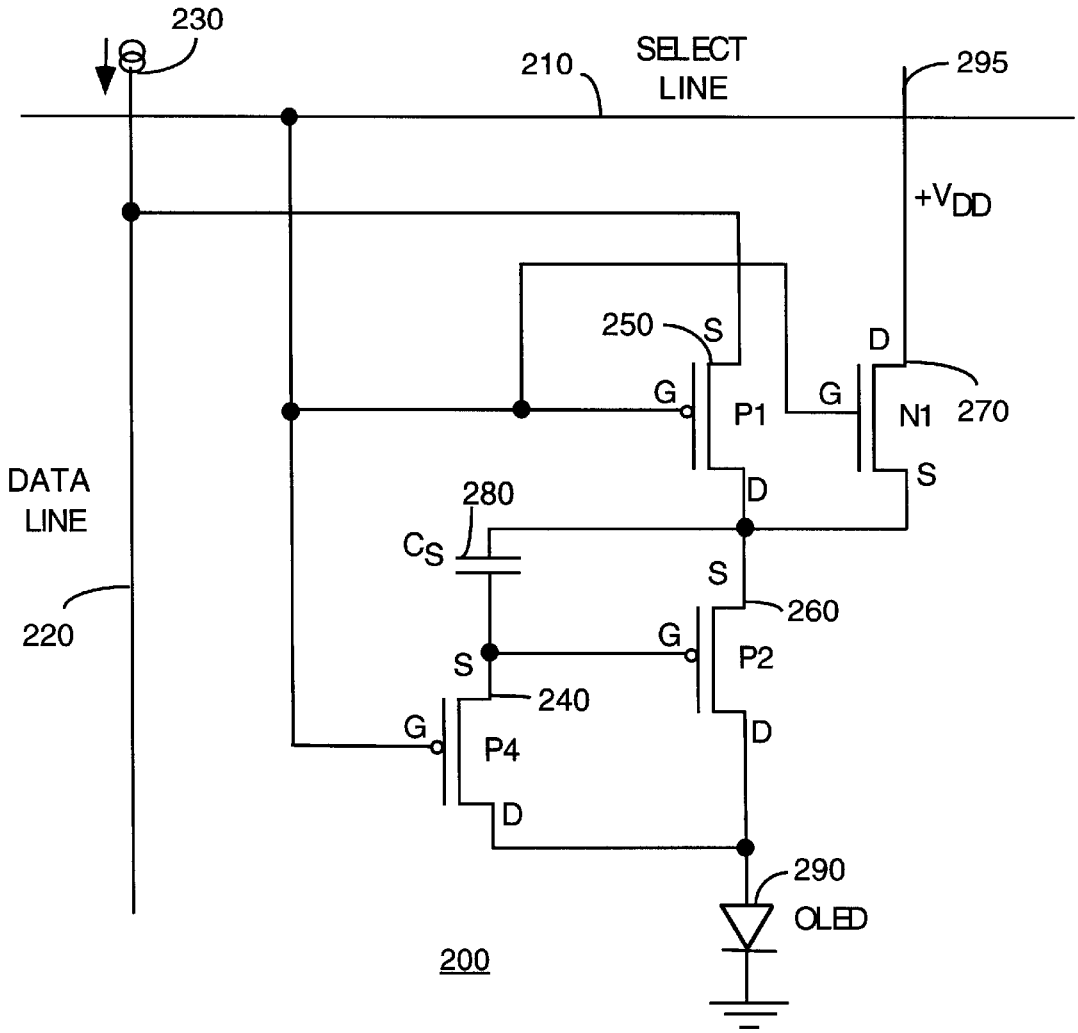
FIG. 2 depicts a schematic diagram of an active matrix LED pixel structure of the present invention.

FIG. 2 depicts a schematic diagram of an active matrix LED pixel structure 200 of the present invention. In the preferred embodiment, the active matrix LED pixel structure is implemented using thin film transistors (TFTs), e.g., transistors manufactured using amorphous or poly-silicon. Similarly, in the preferred embodiment, the active matrix LED pixel structure incorporates an organic light-emitting diode (OLED). Although the present pixel structure is implemented using thin film transistors and an organic light-emitting diode, it should be understood that the present invention can be implemented using other types of transistors and light emitting diodes. For example, if transistors that are manufactured using other materials exhibit the threshold nonuniformity as discussed above, then the present invention can be employed to provide a constant current through the lighting element.

Although the present invention is illustrated below as a single pixel or pixel structure, it should be understood that the pixel can be employed with other pixels, e.g., in an array, to form a display. Furthermore, although the figures below illustrate specific transistor configuration, it should be understood that the source of a transistor is relative to the voltage sign.

Referring to FIG. 2, pixel structure 200 comprises three PMOS transistors 240, 250, 260, a NMOS transistor 270, a capacitor 280 and a LED (OLED) 290 (light element). A select line 210 is coupled to the gate of transistors 240, 250 and 270. A data line is coupled to the source of transistor 250 and a $+V_{DD}$ line is coupled to the drain of transistor 270. One electrode of the OLED 290 is coupled to the drain of transistors 240 and 260. The source of transistor 240 is coupled to the gate of transistor 260 and to one terminal of capacitor 280. Finally, the drain of transistor 250, the source of transistor 270, the source of transistor 260 and one terminal of the capacitor 280 are all coupled together.

The present pixel structure 200 provides a uniform current drive in the presence of a large threshold voltage ($V_t$) nonuniformity. In other words, it is desirable to maintain a uniform current across the OLED, thereby ensuring uniformity in the intensity of the display.

More specifically, the OLED pixel structure is operated in two phases, a load data phase and a continuous illuminating phase.

Load Data Phase

A pixel structure 200 can be loaded with data by activating the proper select line 210. Namely, when the select line is set "Low", transistor P4 (240) is turned "On", where the voltage on the anode side of the OLED 290 is transmitted to the gate of the transistor P2 (260). Concurrently, transistor P1 (250) is also turned "ON" so that the constant current from the data line 220 flows through both the transistor P2 (260) and the OLED 290. Namely, the transistor 260 must turn on to sink the current that is being driven by the current source 230. The current source 230 that drives the data line is programmed by external data. The gate to source voltage of transistor 260 (drive transistor) will then settle to a voltage that is necessary to drive the current. Concurrently, transistor N1 (270) is turned "Off", thereby disconnecting the power supply $+V_{DD}$ from the OLED 290. The constant current source 230 will also self-adjust the source-to-gate voltage to accommodate a fixed overdrive value (voltage) for transistor 260 and will compensate the threshold variation on the polysilicon TFT 260. The overdrive voltage is representative of the data. In turn, the data is properly stored on the storage capacitor Cs 280. This completes the load or write cycle for the data.

Continuous Illuminating Phase

When the select line is set "High", both transistors of P1 (250) and P4 (240) are turned "Off" and the transistor N1 (270) is turned "On". Although the source voltage of the transistor 260 may vary slightly, the source-to-gate voltage of the transistor 260 controls the current level during the illumination cycle. The Vsg of transistor 270 across the capacitor 280 cannot change instantaneously. Thus, the gate voltage on transistor 260 will track with its source voltage such that the source-to-gate voltage is maintained the same throughout the entire Load and Illumination phases. The leakage current of polysilicon TFT and voltage resolution required for gray scale luminance of OLED will determine the size of storage capacitor needed for holding a valid data for a frame time. In the preferred embodiment, the capacitor is on the order of approximately 0.25 pf. Namely, the capacitor must be large enough to account for the current leakage of transistor 260. This completes the pixel operation for the illumination phase.

Figure 6:
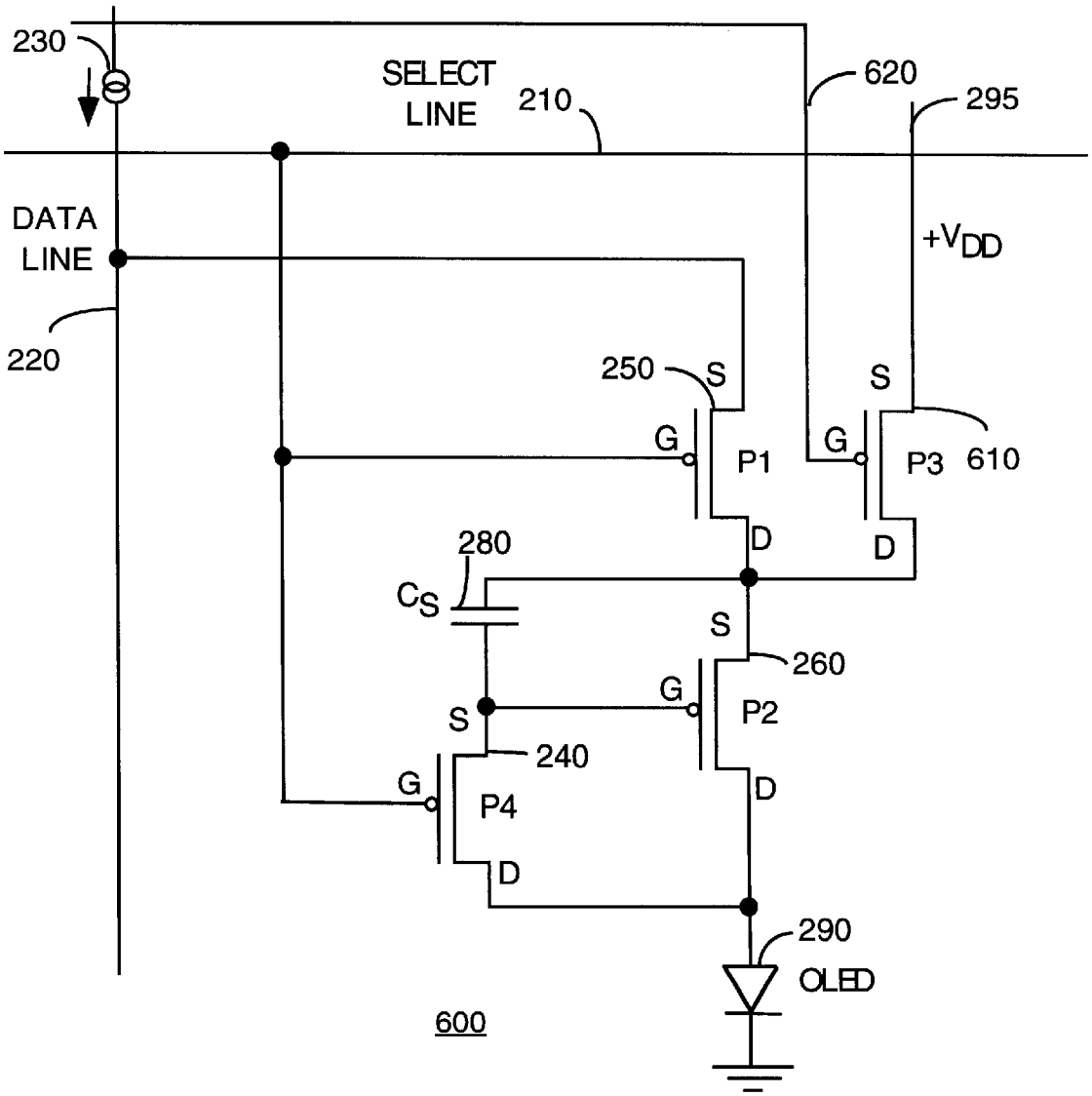
FIG. 6 depicts a schematic diagram of an alternate embodiment of the active matrix LED pixel structure of FIG. 2.

It should be noted that each data/column line 220 has its own programmed constant current source 230. During the illumination phase, the subsequent programmed current source on the data lines feeds through and loads the next rows of all pixels, while the pixels of previous rows are operating in the illumination phase for the whole frame time. Thus, this pixel structure of FIG. 2 requires only 3 PMOS transistors and 1 NMOS transistor with 2.5 lines. (select line, data line-current source and $V_{DD}$ voltage supply which can be shared with adjacent pixels). Alternatively, FIG. 6 illustrates an implementation where the pixel structure of FIG. 2 is implemented with all PMOS transistors, which will provide economy for using either PMOS or NMOS processes only. The NMOS transistor N1 is replaced with a PMOS P3 transistor 610. However, an additional line (control line) 620 is coupled to the gate of transistor 610 for addressing the additional PMOS transistor, thereby requiring a total of 3.5 lines, i.e., an additional voltage supply for controlling the additional PMOS gate.

In sum, the pixel structures of FIG. 2 and FIG. 6 are designed to compensate the threshold variation of both polysilicon TFT and the OLED by self-adjusting/tracking mechanism on Vsg of transistor 260 and by supplying a constant current source through the OLED 290. In fact, the pixel structures of FIG. 2 and FIG. 6 are able to accomplish proper operation during both Load and Illumination phases with hard voltage supply. These pixel structures can be implemented to design high-quality OLED displays with good gray scale uniformity and high lifetime despite instabilities in either the OLED or the pixel polysilicon TFT.

Figure 3:
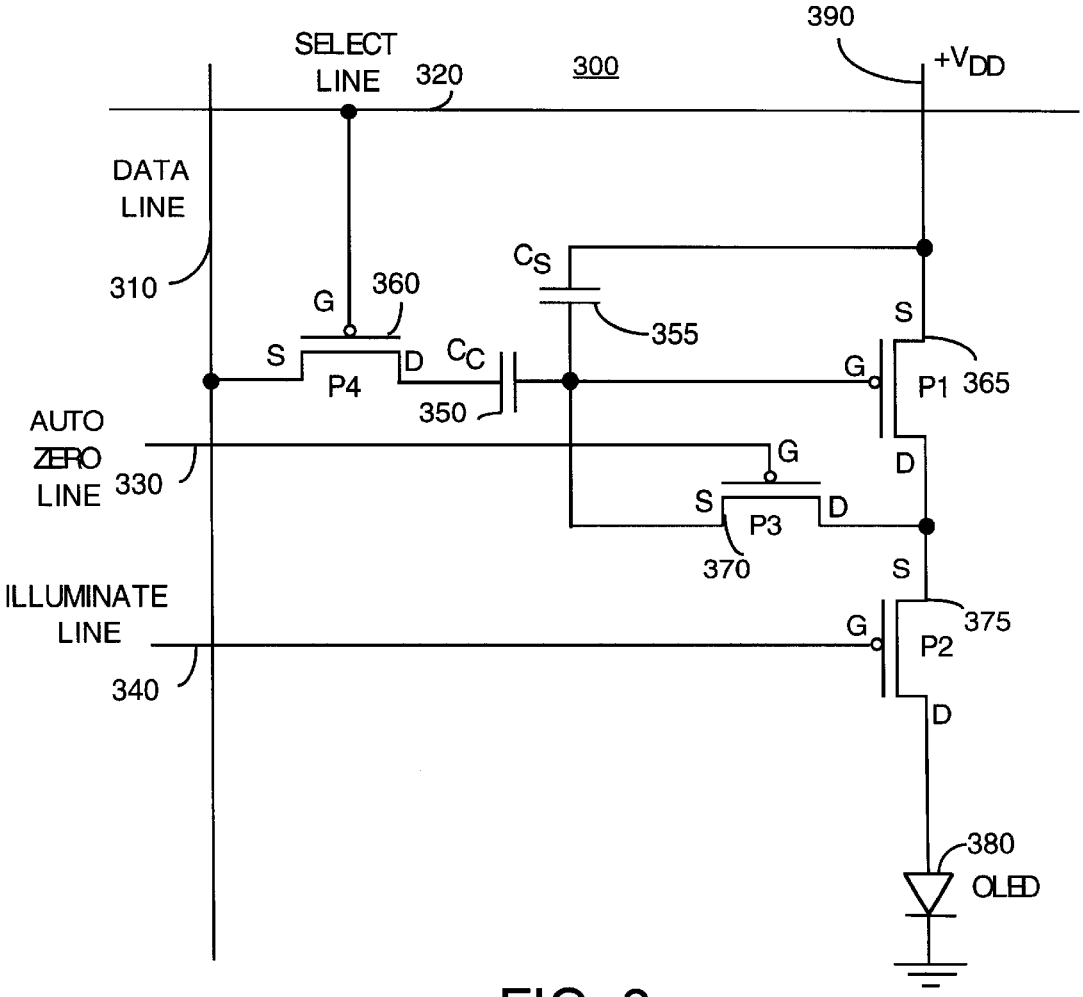
FIG. 3 depicts a schematic diagram of an alternate embodiment of the present active matrix LED pixel structure.

FIG. 3 illustrates an alternate embodiment of the present active matrix pixel structure. In this alternate embodiment, the data line voltage is converted into a current within the pixel structure without the need of a voltage-to-current converter such as the implementation of a current source as discussed above in FIGS. 2 and 6.

Referring to FIG. 3, pixel structure 300 comprises four PMOS transistors (360, 365, 370, 375), two capacitors 350 and 355 and a LED (OLED) 380. A select line 320 is coupled to the gate of transistor 360. A data line 310 is coupled to the source of transistor 360 and a $+V_{DD}$ line is coupled to the source of transistor 365 and one terminal of capacitor 355. An auto-zero line 330 is coupled to the gate of transistor 370 and an illuminate line is coupled to the gate of transistor 375. One electrode of the OLED 280 is coupled to the drain of transistor 375. The source of transistor 375 is coupled to the drain of transistors 365 and 370. The drain of transistor 360 is coupled to one terminal of capacitor 350. Finally, the gate of transistor 365, the source of transistor 370, one terminal of the capacitor 350 and one terminal of the capacitor 355 are all coupled together.

More specifically, FIG. 3 illustrates a pixel structure 300 that is operated in three phases: 1) an auto-zero phase, 2) a load data phase and 3) an illuminating phase.

Auto-zero

When auto-zero line 330 and the illuminate line 340 are set to "Low", transistor P2 (375) and P3 (370) are turned "On" and the voltage on the drain side of transistor P1 (365) is transmitted to the gate and is temporarily connected as a diode. The data line 310 is set to a "reference voltage" and the select line 320 is set to "Low". The reference voltage can be arbitrarily set, but it must be greater than the highest data voltage.

Next, the illuminate line 340 is set to "High", so that transistor P2 375 is turned "Off". The pixel circuit now settles to a threshold of the transistor P1 365 (drive transistor), thereby storing a voltage (an auto-zero voltage) that is the difference between the reference voltage on the data line and the threshold voltage of the transistor P1 365 on the capacitor $C_c$ 350. This sets the gate voltage, or more accurately $V_{SG}$ of transistor 365 to the threshold voltage of transistor 365. This, in turn, will provide a fixed overdrive voltage on transistor P1 (365) regardless of its threshold voltage variation. Finally, Auto Zero line 330 is set to "High", which isolates the gate of transistor P1 365. The purpose of auto-zero is henceforth accomplished.

Load Data Phase

At the end of the Auto Zero phase, the select line was set "Low" and the data line was at a "reference voltage". Now, the data line 310 is set to a data voltage. This data voltage is transmitted through capacitor $C_c$ 350 onto the gate of transistor P1 (365). Next, the select line is set "High". Thus, the $V_{SG}$ of transistor 365 provides transistor 365 with a fixed overdrive voltage for providing a constant current level. This completes the load data phase and the pixel is for illumination.

Continuously Illuminating Data Phase During Deselect Row Phase

With the data voltage stored on the gate of transistor P1 (365), the illuminate line 340 is set to "Low", thereby turning "On" transistor P2 375. The current supplied by the transistor P1 365, is allowed to flow through the OLED 380. In sum, the transistor 365 behaves like a constant current source. This completes the Illumination phase.

Figure 4:
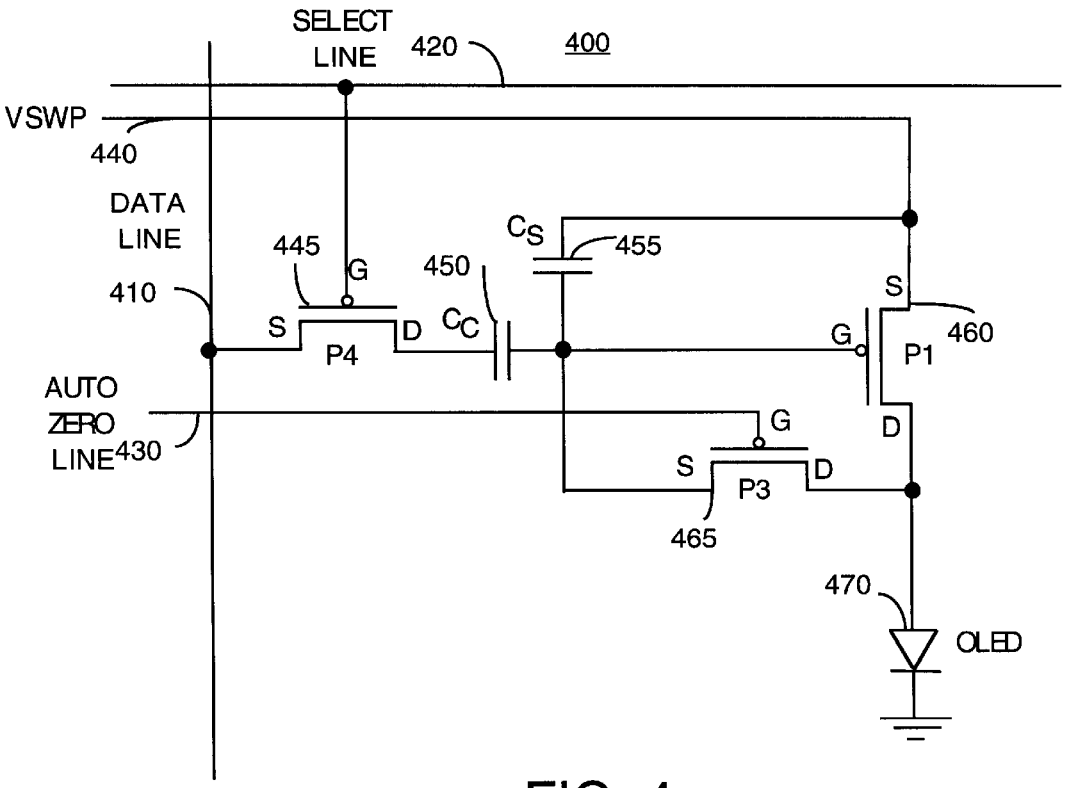
FIG. 4 depicts a schematic diagram of another alternate embodiment of the present active matrix LED pixel structure.

FIG. 4 illustrates another alternate embodiment of the present active matrix pixel structure. In this alternate embodiment, the data line voltage is also converted into a current within the pixel structure without the need of a voltage-to-current converter such as the implementation of a current source as discussed above in FIGS. 2, and 6.

Referring to FIG. 4, pixel structure 400 comprises three PMOS transistors (445, 460, 465), two capacitors 450 and 455 and a LED (OLED) 470. A select line 420 is coupled to the gate of transistor 445. A data line 410 is coupled to the source of transistor 445 and a VSWP line is coupled to the source of transistor 460 and one terminal of capacitor 455. An auto-zero line 430 is coupled to the gate of transistor 465. One electrode of the OLED 470 is coupled to the drain of transistors 465 and 460. The drain of transistor 445 is coupled to one terminal of capacitor 450. Finally, the gate of transistor 460, the source of transistor 465, one terminal of the capacitor 450 and one terminal of the capacitor 455 are all coupled together.

More specifically, FIG. 4 illustrates a pixel structure 400 that is also operated in three phases: 1) an auto-zero phase, 2) a load data phase and 3) an illuminating phase.

Auto-zero (By VSWP) Phase

VSWP (voltage switching supply) is set to a "lower voltage" by the amount "ΔV", where the lower voltage is selected such that the OLED 470 is trickling a small amount of current (depending on the OLED characteristic, e.g., on the order of nanoamp). The lower voltage is coupled through onto the gate of transistor P1 (460) $V_G$(P1) without dilution due to the floating node between the transistor P4 (445) and $C_c$ (450) coupling capacitor. When Auto Zero line 430 is then set to "Low", the transistor P1 (460) (drive transistor) is temporarily connected as a diode by closing the transistor P3 (465). The select line 420 is then set to "Low" and a "reference voltage" is applied on the data line 410. The reference voltage can be arbitrarily set, but it must be greater than the highest data voltage. The pixel circuit is now allowed to settle to the threshold of transistor P1 460. Finally, Auto Zero line 430 is then set to "High", which isolates the gate of transistor P1 460. The effect of this Auto Zero phase is to store on the capacitor $C_c$ 450 a voltage (an auto-zero voltage) that represents the difference between the reference voltage on the data line and the transistor threshold voltage of P1 460. This completes the auto-zero phase.

Load Data Phase

At the end of the Auto Zero phase, the select line was set "Low" and the data line was at a "reference voltage". Next, the data line is then switched from a reference voltage to a lower voltage (data voltage) where the change in the data is referenced to the data. In turn, the data voltage (data input) is load coupled through capacitors 450 and 455 to the gate of transistor P1 460. The voltage $V_{SG}$ of the transistor 460 provides the transistor P1 (460) with a fixed overdrive voltage to drive the current for the OLED 470. Namely, the data voltage will be translated into an overdrive voltage on transistor P1 460. Since the voltage stored on the capacitor 450 accounts for the threshold voltage of the transistor P1 460, the overall overdrive voltage is now independent of the threshold voltage of the transistor P1. The select line 420 is then set "High". This completes the load data phase.

Continuously Illuminate Data During Deselect Row Phase

At the completion of the data loading phase, the gate of transistor P1 460 is now isolated except for its capacitive connections, where the overdrive voltage for driving the OLED is stored on capacitor $C_S$ 455. Next, the VSWP is returned to its original higher voltage (illuminate voltage). In turn, with VSWP rising, there is now sufficient voltage to drive the OLED for illumination. Namely, when select line 420 is set to "High", both transistors P3 (465) and P4 (445) are turned "Off", and the data voltage is kept in storage on $V_{SG}$ of transistor 460 as before. This source-to-gate voltage $V_{SG(P1)}$ is maintained in the same manner throughout the entire Illumination phase, which means the current level through the OLED will be constant. This completes the Illumination cycle.

In sum, FIG. 3 discloses a pixel structure that uses 4 PMOS transistors and 1 coupling capacitor with 3½ lines. (Auto-Zero line and VDDH voltage supply can both be shared). FIG. 4 discloses a pixel structure that uses only 3 PMOS transistors and 1 coupling capacitor with 2½ line. (VSWP switching power supply could be share with adjacent pixel) Both of these two pixel structures can compensate the threshold variation of both polysilicon TFT and OLED by illuminating and auto-zero trickling current mechanism on $V_{SG(P1)}$. The aforementioned two (2) pixel structures can also be implemented in polysilicon NMOS and in amorphous NMOS design.

The two (2) pixel structures of FIG. 3 and FIG. 4 can be implemented to design high-quality OLED with good gray scale uniformity and high lifetime despite instabilities in either the OLED or the pixel polysilicon TFT.

Figure 5:
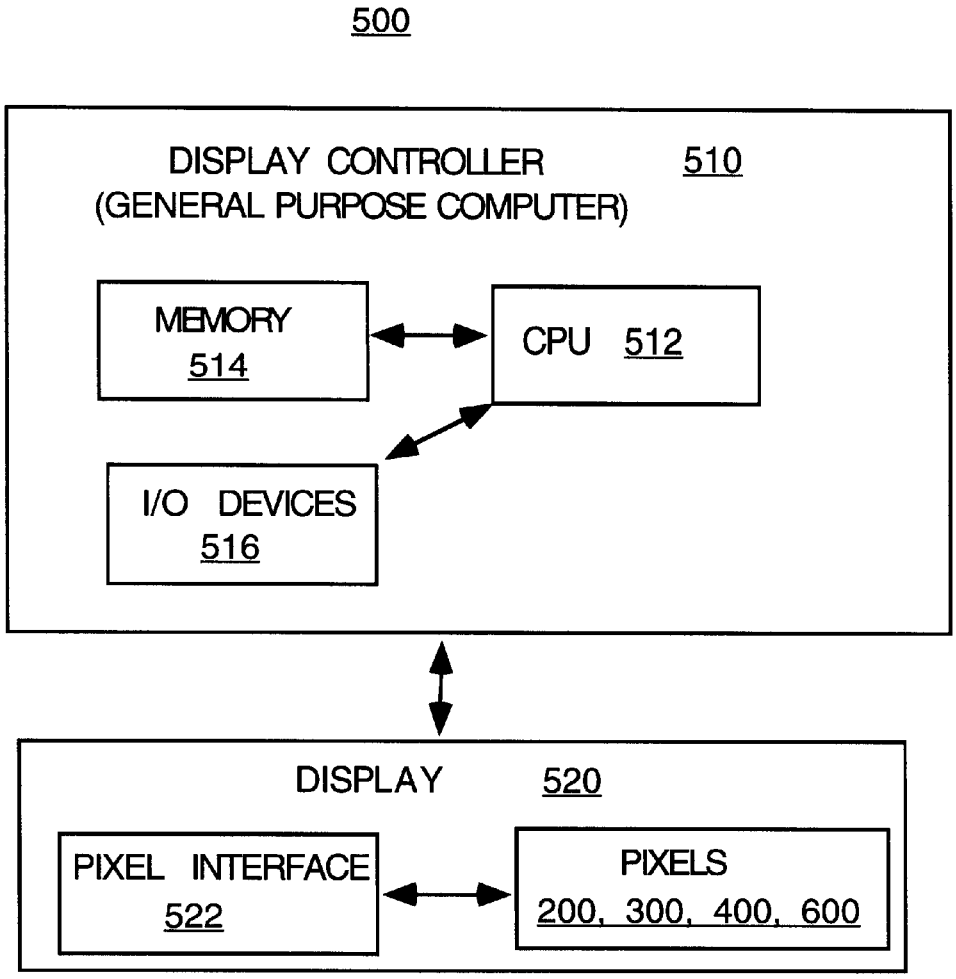
FIG. 5 depicts a block diagram of a system employing a display having a plurality of active matrix LED pixel structures of the present invention.

FIG. 5 illustrates a block diagram of a system 500 employing a display 520 having a plurality of active matrix LED pixel structures 200, 300, 400 or 600 of the present invention. The system 500 comprises a display controller 510 and a display 520.

More specifically, the display controller can be implemented as a general purpose computer having a central processing unit CPU 512, a memory 514 and a plurality of I/O devices 416 (e.g., a mouse, a keyboard, storage devices, e.g., magnetic and optical drives, a modem and the like). Software instructions for activating the display 520 can be loaded into the memory 514 and executed by the CPU 512.

Figure 1:
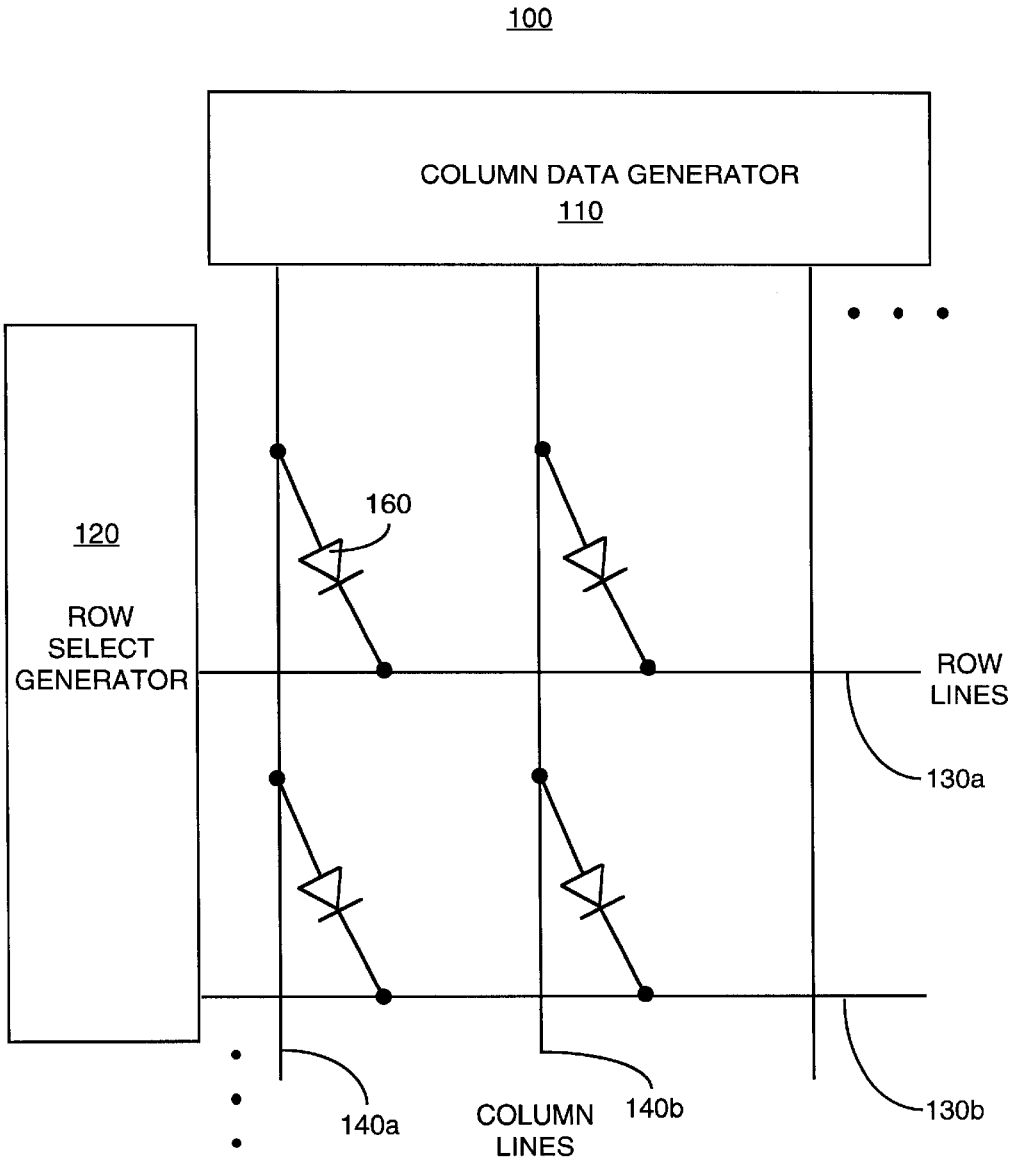
(PRIOR ART) FIG. 1
FIG. 1 depicts a block diagram of a matrix addressing interface.

The display 520 comprises a pixel interface 522 and a plurality of pixels (pixel structures 200, 300, 400 or 600). The pixel interface 522 contains the necessary circuitry to drive the pixels 200, 300, 400 or 600. For example, the pixel interface 522 can be a matrix addressing interface as illustrated in FIG. 1.

Thus, the system 500 can be implemented as a laptop computer. Alternatively, the display controller 510 can be implemented in other manners such as a microcontroller or application specific integrated circuit (ASIC) or a combination of hardware and software instructions. In sum, the system 500 can be implemented within a larger system that incorporates a display of the present invention.

Although the present invention is described using PMOS transistors, it should be understood that the present invention can be implemented using NMOS transistors, where the relevant voltages are reversed. Namely, the OLED is now coupled to the source of the NMOS drive transistor. By flipping the OLED, the cathode of the OLED should be made with a transparent material.

Although various embodiments which incorporate the teachings of the present invention have been shown and described in detail herein, those skilled in the art can readily devise many other varied embodiments that still incorporate these teachings.

What is claimed is:

1. A display comprising a plurality of pixels, each pixel comprising:

a first transistor having a gate, a source and a drain, where said gate is coupled to a select line, where said source is coupled to a data line;

a second transistor having a gate, a source and a drain, where said gate of said second transistor is coupled said select line, where said drain of said second transistor is coupled to a $V_{DD}$ line, where said source of said second transistor is coupled to said drain of said first transistor;

a third transistor having a gate, a source and a drain, where said gate of said third transistor is coupled said select line;

a capacitor having a first terminal and a second terminal, where said source of said third transistor is coupled to said first terminal of said capacitor, where said second terminal of said capacitor is coupled to said drain of said first transistor;

a fourth transistor having a gate, a source and a drain, where said source of said fourth transistor is coupled to said drain of said first transistor, where said gate of said fourth transistor is coupled said source of said third transistor; and a light element having two terminals, where said drain of said fourth transistor and said drain of said third transistor are coupled to one of said terminal of said light element.

2. The display of claim 1, wherein said light element is an organic light emitting diode (OLED).

3. The display of claim 1, wherein said first, third and fourth transistors are PMOS transistors and wherein said second transistor is a NMOS transistor.

4. The display of claim 1, further comprising:

a current source coupled to said data line.

5. A display comprising a plurality of pixels, each pixel comprising:

a first transistor having a gate, a source and a drain, where said gate is coupled to a select line, where said source is coupled to a data line;

a second transistor having a gate, a source and a drain, where said gate of said second transistor is coupled a control line, where said source of said second transistor is coupled to a $V_{DD}$ line, where said drain of said second transistor is coupled to said drain of said first transistor;

a third transistor having a gate, a source and a drain, where said gate of said third transistor is coupled said select line;

a capacitor having a first terminal and a second terminal, where said source of said third transistor is coupled to said first terminal of said capacitor, where said second terminal of said capacitor is coupled to said drain of said first transistor;

a fourth transistor having a gate, a source and a drain, where said source of said fourth transistor is coupled to said drain of said first transistor, where said gate of said fourth transistor is coupled said source of said third transistor; and a light element having two terminals, where said drain of said fourth transistor and said drain of said third transistor are coupled to one of said terminal of said light element.

6. The display of claim 5, wherein said light element is an organic light emitting diode (OLED).

7. The display of claim 5, wherein said first, second, third and fourth transistors are PMOS transistors.

8. The display of claim 5, further comprising:

a current source coupled to said data line.

9. A display comprising a plurality of pixels, each pixel comprising:

a first transistor having a gate, a source and a drain, where said gate is coupled to a select line, where said source is coupled to a data line;

a first capacitor having a first terminal and a second terminal, where said drain of said first transistor is coupled to said first terminal of said first capacitor;

a second transistor having a gate, a source and a drain, where said source of said second transistor is coupled to a $V_{DD}$ line, where said gate of said second transistor is coupled to said second terminal of said first capacitor;

a second capacitor having a first terminal and a second terminal, where said gate of said second transistor is coupled to said first terminal of said second capacitor, where said source of said second transistor is coupled to said second terminal of said second capacitor;

a third transistor having a gate, a source and a drain, where said gate of said third transistor is coupled an auto-zero line, where said source of said third transistor is coupled to said gate of said second transistor, where said drain of said third transistor is coupled to said drain of said second transistor;

a fourth transistor having a gate, a source and a drain, where said gate of said fourth transistor is coupled to an illuminate line, where said source of said fourth transistor is coupled to said drain of said third transistor; and a light element having two terminals, where said drain of said fourth transistor is coupled to one of said terminal of said light element.

10. The display of claim 9, wherein said light element is an organic light emitting diode (OLED).

11. The display of claim 9, wherein said first, second, third and fourth transistors are PMOS transistors.

12. A display comprising a plurality of pixels, each pixel comprising:

a first transistor having a gate, a source and a drain, where said gate is coupled to a select line, where said source is coupled to a data line;

a first capacitor having a first terminal and a second terminal, where said drain of said first transistor is coupled to said first terminal of said first capacitor;

a second transistor having a gate, a source and a drain, where said source of said second transistor is coupled to a VSWP line, where said gate of said second transistor is coupled to said second terminal of said first capacitor;

a second capacitor having a first terminal and a second terminal, where said gate of said second transistor is coupled to said first terminal of said second capacitor, where said source of said second transistor is coupled to said second terminal of said second capacitor;

a third transistor having a gate, a source and a drain, where said gate of said third transistor is coupled an auto-zero line, where said source of said third transistor is coupled to said gate of said second transistor, where said drain of said third transistor is coupled to said drain of said second transistor; and a light element having two terminals, where said drain of said second transistor is coupled to one of said terminal of said light element.

13. The display of claim 12, wherein said light element is an organic light emitting diode (OLED).

14. The display of claim 12, wherein said first, second, and third transistors are PMOS transistors.

15. A circuit for driving a light element having two terminals, said circuit comprising:

a first transistor having a gate, a source and a drain, where said gate is coupled to a select line, where said source is coupled to a data line;

a first capacitor having a first terminal and a second terminal, where said drain of said first transistor is coupled to said first terminal of said first capacitor;

a second transistor having a gate, a source and a drain, where said source of said second transistor is coupled to a $V_{DD}$ line, where said gate of said second transistor is coupled to said second terminal of said first capacitor;

a second capacitor having a first terminal and a second terminal, where said gate of said second transistor is coupled to said first terminal of said second capacitor, where said source of said second transistor is coupled to said second terminal of said second capacitor;

a third transistor having a gate, a source and a drain, where said gate of said third transistor is coupled an auto-zero line, where said source of said third transistor is coupled to said gate of said second transistor, where said drain of said third transistor is coupled to said drain of said second transistor; and a fourth transistor having a gate, a source and a drain, where said gate of said fourth transistor is coupled to an illuminate line, where said source of said fourth transistor is coupled to said drain of said third transistor, where said drain of said fourth transistor is for coupling to the light element.

16. A system comprising:

a display controller; and a display, coupled to said display controller, where said display comprises a plurality of pixels, where each pixel comprises:

a first transistor having a gate, a source and a drain, where said gate is coupled to a select line, where said source is coupled to a data line;

a first capacitor having a first terminal and a second terminal, where said drain of said first transistor is coupled to said first terminal of said first capacitor;

a second transistor having a gate, a source and a drain, where said source of said second transistor is coupled to a $V_{DD}$ line, where said gate of said second transistor is coupled to said second terminal of said first capacitor;

a second capacitor having a first terminal and a second terminal, where said gate of said second transistor is coupled to said first terminal of said second capacitor, where said source of said second transistor is coupled to said second terminal of said second capacitor;

a third transistor having a gate, a source and a drain, where said gate of said third transistor is coupled an auto-zero line, where said source of said third transistor is coupled to said gate of said second transistor, where said drain of said third transistor is coupled to said drain of said second transistor;

a fourth transistor having a gate, a source and a drain, where said gate of said fourth transistor is coupled to an illuminate line, where said source of said fourth transistor is coupled to said drain of said third transistor; and a light element having two terminals, where said drain of said fourth transistor is coupled to one of said terminal of said light element.

* * * * *